US008890792B2

(12) United States Patent
Hiramatsu et al.

(10) Patent No.: US 8,890,792 B2
(45) Date of Patent: Nov. 18, 2014

(54) DISPLAY CONTROL APPARATUS AND METHOD, AND PROGRAM

(75) Inventors: Takeshi Hiramatsu, Tokyo (JP); Mitsuyasu Asano, Tokyo (JP); Tetsuji Inada, Kanagawa (JP); Koji Nishida, Tokyo (JP)

(73) Assignee: Sony Corporation (JP)

( * ) Notice: Subject to any disclaimer, the term of this patent is extended or adjusted under 35 U.S.C. 154(b) by 615 days.

(21) Appl. No.: 12/451,964

(22) PCT Filed: Apr. 10, 2009

(86) PCT No.: PCT/JP2009/057392

§ 371 (c)(1),
(2), (4) Date: Dec. 7, 2009

(87) PCT Pub. No.: WO2009/125850

PCT Pub. Date: Oct. 15, 2009

(65) Prior Publication Data

US 2010/0117948 A1 May 13, 2010

(30) Foreign Application Priority Data

Apr. 11, 2008 (JP) ..... P2008-103389

(51) Int. Cl.
*G09G 3/36* (2006.01)
*G09G 5/10* (2006.01)
*G09G 3/34* (2006.01)

(52) U.S. Cl.
CPC ..... *G09G 3/3426* (2013.01); *G09G 2360/16* (2013.01); *G09G 2320/0646* (2013.01)
USPC ..... 345/102; 345/690

(58) Field of Classification Search
CPC ..... G09G 3/36; G09G 3/342; G09G 3/3406; G09G 2320/064; G09G 2320/0646; G09G 2320/0626; G09G 2320/0633; G09G 2360/16; G09G 2330/021
USPC ..... 345/102
See application file for complete search history.

(56) References Cited

U.S. PATENT DOCUMENTS

2001/0035853 A1 11/2001 Hoelen et al.

(Continued)

FOREIGN PATENT DOCUMENTS

EP 1705636 A1 9/2006
EP 1788550 A1 5/2007

(Continued)

OTHER PUBLICATIONS

Trentacoste et al: "Photometric image processing for high dynamic range displays", Journal of Visual Communication and Image Representation, Academic Press, Inc, US, vol. 18, No. 5, Sep. 5, 2007, pp. 439-451, XP 022231050.
Supplementary European Search Report EP 09731168, dated Apr. 28, 2011.
Communication from EP Application No. 09731168.2, dated Aug. 3, 2012.

*Primary Examiner* — Kenneth Bukowski
(74) *Attorney, Agent, or Firm* — Lerner, David, Littenberg, Krumholz & Mentlik, LLP

(57) ABSTRACT

A display control apparatus may include a necessary light emission level calculation unit that calculates a necessary attention block light emission level of a back light in an attention block which satisfies a necessary luminance based on an image signal. A first neighborhood block light emission level calculation unit may calculate a light emission level of first neighborhood blocks which satisfies a deficient luminance by a light emission contribution amount to the attention block through light emission in first neighborhood blocks of the attention block which satisfies the deficient luminance by the back light in the attention block. The back light in the attention block emits the light at the largest light emission level at which the light can be emitted and back lights in the first neighborhood blocks emit the light at the first neighborhood block light emission level.

7 Claims, 10 Drawing Sheets

(56) References Cited

U.S. PATENT DOCUMENTS

| | | | | |
|---|---|---|---|---|
| 2006/0087486 | A1* | 4/2006 | Lee | 345/102 |
| 2006/0214904 | A1* | 9/2006 | Kimura et al. | 345/102 |
| 2007/0097321 | A1* | 5/2007 | Whitehead et al. | 353/30 |
| 2007/0109240 | A1* | 5/2007 | Jung | 345/87 |

FOREIGN PATENT DOCUMENTS

| | | | |
|---|---|---|---|
| JP | 2007-183499 | A | 7/2007 |
| JP | 2007-322901 | A | 12/2007 |
| WO | 03/077013 | A3 | 3/2004 |
| WO | 2007141721 | A1 | 12/2007 |

* cited by examiner

DISPLAY CONTROL APPARATUS AND METHOD, AND PROGRAM

CROSS-REFERENCES TO RELATED APPLICATIONS

The present application is a national phase entry under 35 U.S.C. §371 of International Application No. PCT/JP2009/057392 filed Apr. 10, 2009, published on Oct. 15, 2009 as WO 2009/125850 A1, which claims priority from Japanese Patent Application No. JP 2008-103389 filed in the Japanese Patent Office on Apr. 11, 2008.

TECHNICAL FIELD

The present invention relates to a display control apparatus and method, and a program, in particular, a display control apparatus and method, and a program with which a luminance deficiency by a back light can be suppressed.

BACKGROUND ART

Up to now, as a liquid crystal display apparatus utilizing a transmission type liquid crystal panel, one is proposed with which a dynamic range expansion of a luminance of an image to be displayed is realized by changing an amount of incident light for each of display areas (blocks) on the liquid crystal panel with use of a plurality of back lights (for example, see Patent Document 1).

In this manner, in a case where the light is incident from the respective plural back lights on the respective corresponding display areas of the liquid crystal panel, as shown in FIG. 1, the light amount that should be emitted from the respective back lights is obtained from an image signal of the image to be displayed.

That is, in FIG. 1, an image signal with a step-like wave pattern indicated by an arrow A11 is input to a light emission amount calculation unit 11 and a division unit 12, and in the light emission amount calculation unit 11, on the basis of the image signal, the light amount that should be emitted from one back light 13 is calculated. Also, in the division unit 12, by dividing the supplied image signal by the light amount from the light emission amount calculation unit 11, a transmittance of the light in a display area of a liquid crystal panel 14 corresponding to the back light 13 is calculated. It should be noted that in the wave pattern of FIG. 1, the lateral axis represents a horizontal position of the back light, and a center position represents a center position in the display area of the back light 13.

Herein, as the size of the one back light 13 is larger than the size of a pixel in the display area of the liquid crystal panel 14, the light amount of the back light 13 is calculated from a pixel value of each pixel for the image displayed in the display area of the liquid crystal panel 14 corresponding to the back light 13.

Then, when the light amount is calculated, the back light 13 emits the light on the basis of the light amount calculated by the light emission amount calculation unit 11, and the light is incident on the liquid crystal panel 14. According to this, from the back light 13, a light with a wave pattern indicated by an arrow A12 is projected. That is, as the light from the back light 13 is diffused, the light amount at the center of the light is the largest, and the light amount decreases as being away from the center.

Also, the liquid crystal panel 14 transmits the light from the back light 13 with a wave pattern indicated by an arrow A13, that is, at a transmittance calculated by the division unit 12.

According to this, in the display area of the liquid crystal panel 14, as indicated by an arrow A14, an image almost the same as the image of the input image signal is displayed.

RELATED ART

Patent Document

Patent Document 1: Japanese Unexamined Patent Application Publication No. 2007-322901

DISCLOSURE OF INVENTION

Technical Problem

Incidentally, when the light emission amount is decided for each of the plural display areas, in a case where a light emission amount equal to or larger than an upper limit of the back light to be mounted is calculated as an expected value or a case where the other center block light emission amount is desired to be allocated to a surrounding block, if the light emission amount is simply distributed, the necessary luminance at the center block may not be secured in some cases.

In particular, in a case where a light emission pattern after the allocation is circularized while imitating a natural diffusion, if simply changed, a light emission efficiency tends to decrease.

The present invention has been made in view of the above-mentioned circumstances and is aimed at suppressing the luminance deficiency by the back light.

Technical Solution

A display control apparatus according to an aspect of the present invention includes: necessary attention block light emission level calculation means configured to calculate a light emission level by a back light in an attention block among back lights composed of a plurality of blocks as a necessary attention block light emission level which satisfies a necessary luminance based on an image signal; necessary first neighborhood block light emission level calculation means configured to calculate, in a case where a largest light emission level at which light can be emitted by the back light in the attention block is deficient with respect to the necessary attention block light emission level, a light emission level of first neighborhood blocks as a necessary first neighborhood block light emission level which satisfies a deficient luminance with respect to the necessary luminance by the largest light emission level at which the light can be emitted by the back light in the attention block by a light emission contribution amount to the attention block through light emission in the first neighborhood blocks in a neighborhood of the attention block which satisfies the deficient luminance by the back light in the attention block; and back light light-emission control means configured to cause the back light in the attention block to emit the light at the largest light emission level at which the light can be emitted and back lights in the first neighborhood blocks to emit the light at the necessary first neighborhood block light emission level.

It is possible to further include necessary second neighborhood block light emission level calculation means configured to calculate, in a case where a largest light emission level at which the light can be emitted by the back lights in the first neighborhood blocks is deficient with respect to the necessary first neighborhood block light emission level, a light emission level of second neighborhood blocks as a necessary second neighborhood block light emission level which satisfies a deficient luminance with respect to the necessary luminance by the largest light emission level at which the light can be emitted by the back lights in the attention block and the first neighborhood blocks by a light emission contribution amount to the attention block through light emission in the second neighborhood blocks in a neighborhood of the attention block and a neighborhood farther than the first neighborhood blocks, and the back light light-emission control means can cause the back light in the attention block and the back lights in the first neighborhood blocks to emit the light at the respective largest light emission levels and back lights in the second neighborhood blocks to emit the light at the necessary second neighborhood block light emission level.

It is possible to further include first weight addition means configured to add a weight on the light emission level of the first neighborhood blocks calculated by the necessary first neighborhood block light emission level calculation means while corresponding to a shape of the light spread from the attention block.

It is possible to further include second weight addition means configured to add a weight on the light emission level of the second neighborhood blocks calculated by the necessary second neighborhood block light emission level calculation unit while corresponding to the shape of the light spread from the attention block.

A display control method according to an aspect of the present invention includes: a necessary attention block light emission level calculation step of calculating a light emission level by a back light in an attention block among back lights composed of a plurality of blocks as a necessary attention block light emission level which satisfies a necessary luminance based on an image signal; a necessary first neighborhood block light emission level calculation step of calculating, in a case where a largest light emission level at which light can be emitted by the back light in the attention block is deficient with respect to the necessary attention block light emission level, a light emission level of first neighborhood blocks as a necessary first neighborhood block light emission level which satisfies a deficient luminance with respect to the necessary luminance by the largest light emission level at which the light can be emitted by the back light in the attention block by a light emission contribution amount to the attention block through light emission in the first neighborhood blocks in a neighborhood of the attention block which satisfies the deficient luminance by the back light in the attention block; and a back light light-emission control step of causing the back light in the attention block to emit the light at the largest light-emission level at which the light can be emitted and back lights in the first neighborhood blocks to emit the light at the necessary first neighborhood block light emission level.

A program according to an aspect of the present invention causes a computer to execute a processing including: a necessary attention block light emission level calculation step of calculating a light emission level by a back light in an attention block among back lights composed of a plurality of blocks as a necessary attention block light emission level which satisfies a necessary luminance based on an image signal; a necessary first neighborhood block light emission level calculation step of calculating, in a case where a largest light emission level at which light can be emitted by the back light in the attention block is deficient with respect to the necessary attention block light emission level, a light emission level of first neighborhood blocks as a necessary first neighborhood block light emission level which satisfies a deficient luminance with respect to the necessary luminance by the largest light emission level at which the light can be emitted by the back light in the attention block by a light emission contribution amount to the attention block through light emission in the first neighborhood blocks in a neighborhood of the attention block which satisfies the deficient luminance by the back light in the attention block; and a back light light-emission control step of causing the back light in the attention block to emit the light at the largest light emission level at which the light can be emitted and back lights in the first neighborhood blocks to emit the light at the necessary first neighborhood block light emission level.

According to an aspect of the present invention, the light emission level by the back light in the attention block which satisfies the necessary luminance based on the image signal among the back lights composed of the plurality of blocks is calculated as the necessary attention block light emission level, in a case where the largest light emission level at which the light can be emitted by the back light in the attention block is deficient with respect to the necessary attention block light emission level, the light emission level of first neighborhood blocks is calculated as the necessary first neighborhood block light emission level which satisfies the deficient luminance by the back light in the attention block with respect to the necessary luminance by the largest light emission level at which the light can be emitted by the back light in the attention block at the light emission contribution amount to the attention block by the light emission in the first neighborhood blocks in the neighborhood of the attention block which satisfies the deficient luminance by the back light in the attention block, and the back light in the attention block is caused to emit the light at the largest light emission level at which the light can be emitted and the back lights in the first neighborhood blocks are caused to emit the light at the necessary first neighborhood block light emission level.

Advantageous Effects

According to an aspect of the present invention, the luminance deficiency by the back light can be suppressed.

BEST MODES FOR CARRYING OUT THE INVENTION

Hereinafter, with reference to the drawings, embodiments to which the present invention is applied will be described.

Figure 1:
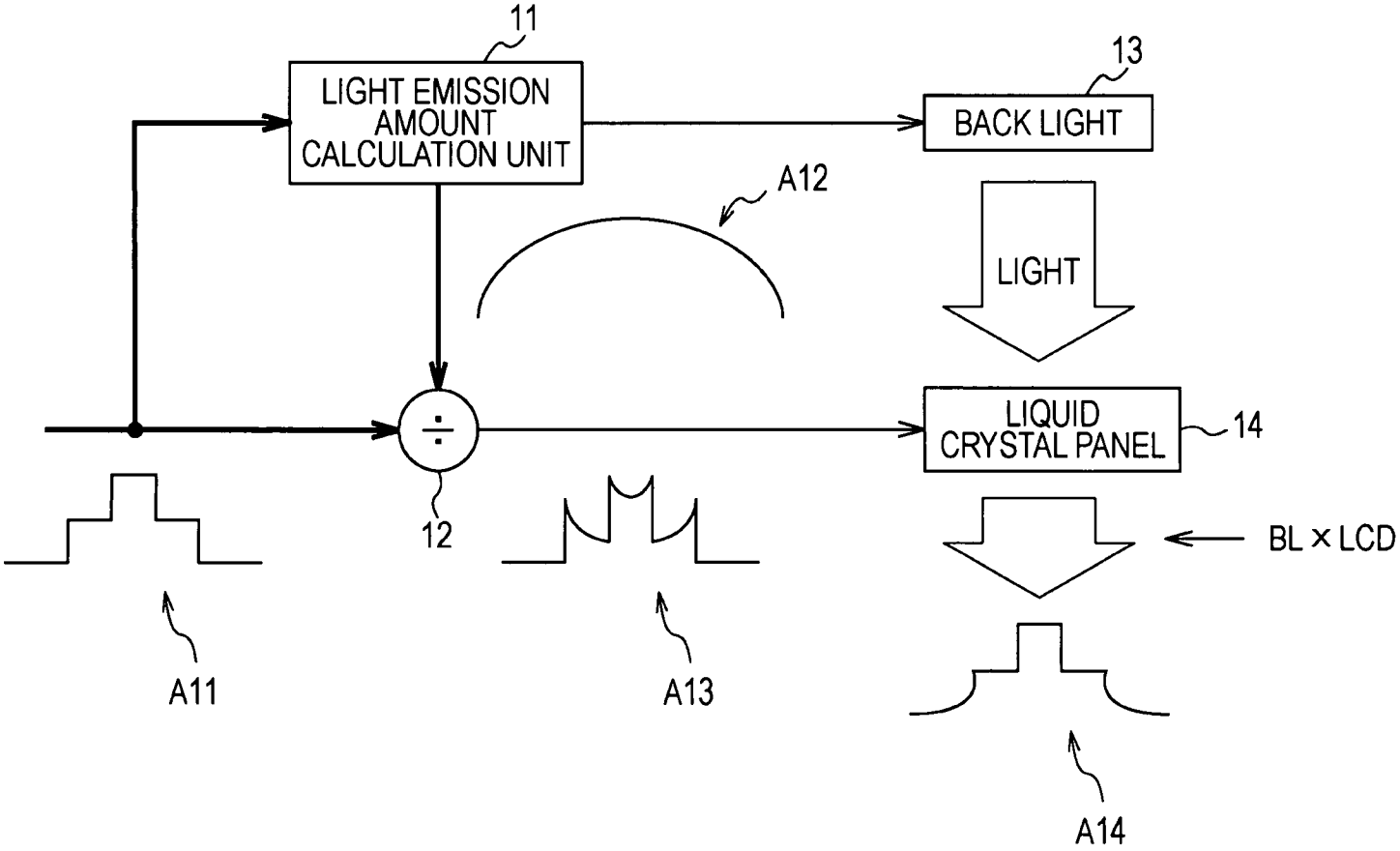
FIG. 1 shows a configuration of a conventional liquid crystal display apparatus.
Figure 2:
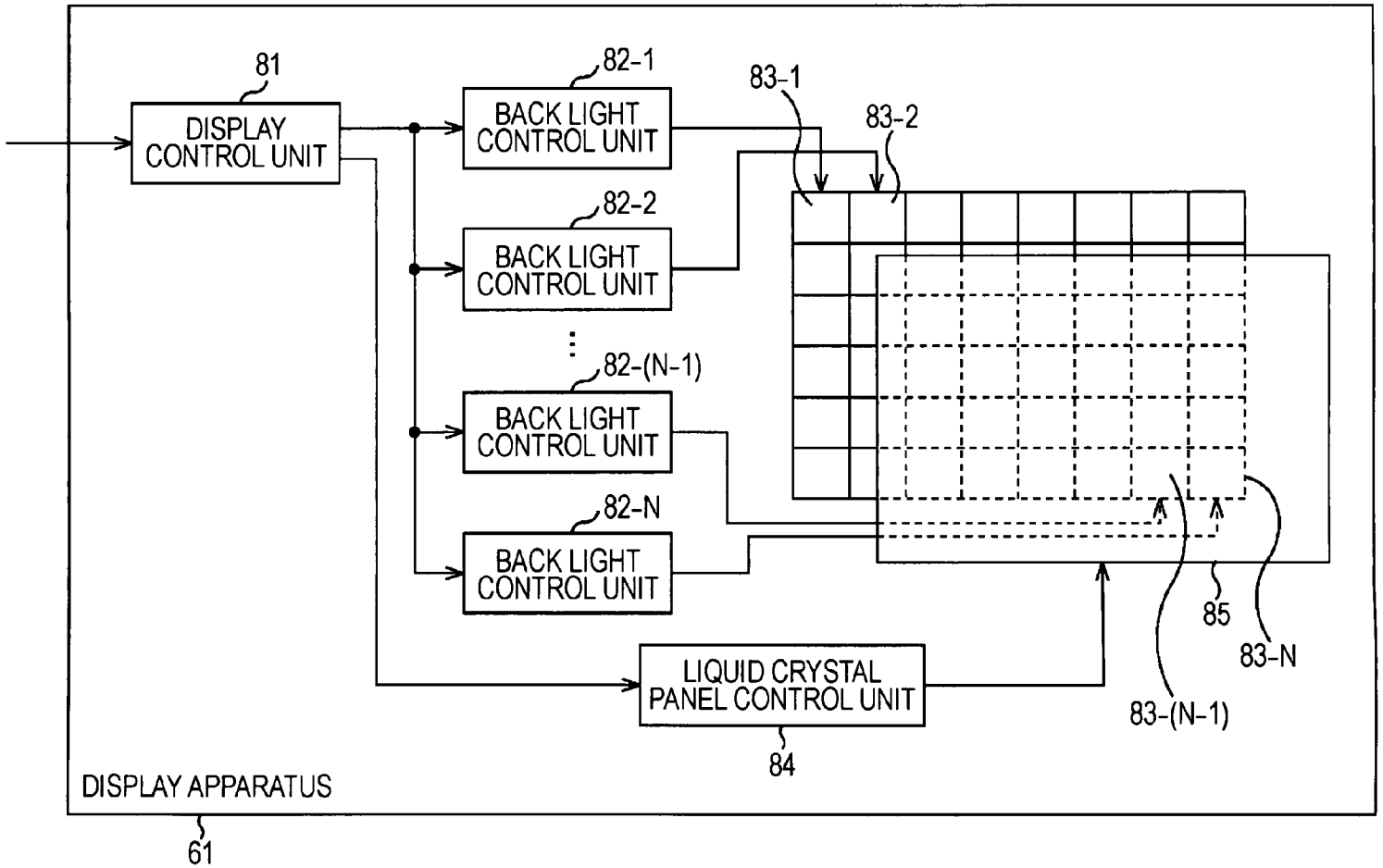
FIG. 2 shows a configuration example of an embodiment of a display apparatus to which the present invention is applied.

FIG. 2 shows a configuration example of an embodiment of a display apparatus to which the present invention is applied.

A display apparatus 61 is composed of a display control unit 81, back light control units 82-1 to 82-N, back lights 83-1 to 83-N, a liquid crystal panel control unit 84, and a liquid crystal panel 85.

The display apparatus 61 is, for example, a liquid crystal display apparatus such as a liquid crystal display, and to the display control unit 81 of the display apparatus 61, an image signal of a display image to be displayed on the liquid crystal panel 85 is input.

On the basis of the input image signal, the display control unit 81 calculates a light amount of the light projected from the back lights 83-1 to 83-N, in more detail, a back luminance indicating a luminance of the light to be supplied to the back light control units 82-1 to 82-N.

Also, on the basis of the image signal, for each of the display areas (blocks) in the liquid crystal panel 85 where a majority of the light from the respective back lights 83-1 to 83-N is incident, the display control unit 81 calculates a transmittance of the respective pixels in the display area to be supplied to the liquid crystal panel control unit 84. This transmittance is set as a value, for example, from 0 to 1.

It should be noted that the pixel in the display area of the liquid crystal panel 85 is the display unit of the image and referred to as one cell composed of the respective areas where the respective lights of R, G, and B are transmitted.

On the basis of the back light luminance supplied from the display control unit 81, the back light control units 82-1 to 82-N controls the back lights 83-1 to 83-N to emit the light. Also, the back lights 83-1 to 83-N emit the light by the control of the back light control units 82-1 to 82-N, and the light is incident on the liquid crystal panel 85.

It should be noted that the back lights 83-1 to 83-N are respectively configured to emit the light in the area for one block when the entire back light is divided into N display areas (blocks). In view of the above, hereinafter, the blocks corresponding to the back lights 83-1 to 83-N in the entire back light are referred to as blocks B1 to BN while being associated with a value after the hyphen of the respective reference symbols. Therefore, the back lights 83-1 to 83-N are respectively configured to emit the light in the display areas of the blocks B1 to BN of the entire back light. Alternatively, the light is emitted in the display areas of the blocks B1 to BN by the back lights 83-1 to 83-N.

The liquid crystal panel control unit 84 causes the liquid crystal panel 85 to transmit the light at the transmittance of the respective pixels supplied from the display control unit 81, that is, the aperture rate. The liquid crystal panel 85 transmits the light incident on the respective pixels in the display areas from the back lights 83-1 to 83-N at the transmittance instructed from the liquid crystal panel control unit 84 and displays the display image.

It should be noted that hereinafter, in a case where it is unnecessary to distinguish the respective back light control units 82-1 to 82-N and the back lights 83-1 to 83-N individually, those are simply referred to as back light control unit 82 and back light 83, respectively, and other configurations are also similarly referred to. Also, an overall configuration of the back light composed of the plurality of back lights 83 represents the entire back light.

In the display apparatus 61, the back light 83 serving as a light source is arranged on a back face of the liquid crystal panel 85, and a majority of the light projected from the back light 83 is incident on the display areas (blocks) of the liquid crystal panel 85 opposing the back light 83. For example, a majority of the light emitted from the back light 83-1 is incident on a part on an upper left side in the illustration of the liquid crystal panel 85. Therefore, in the illustration of the liquid crystal panel 85, in a case where an image is displayed in which the upper left side is bright and other parts are dark, it is possible to cause only the back light 83-1 to emit the light at a high luminance to some extent and the other back lights 83-2 to 83-N to emit the light at a relatively low luminance. According to this, it is possible to suppress the power consumption of the back light 83, and also the dynamic range of the luminance of the display image can be further expanded.

It should be noted that the transmission type liquid crystal panel 85 is provided to the display apparatus 61, but without a limit to the liquid crystal panel, any transmission type display panel for displaying an image while transmitting the light from the back light 83 may also be used.

Figure 3:
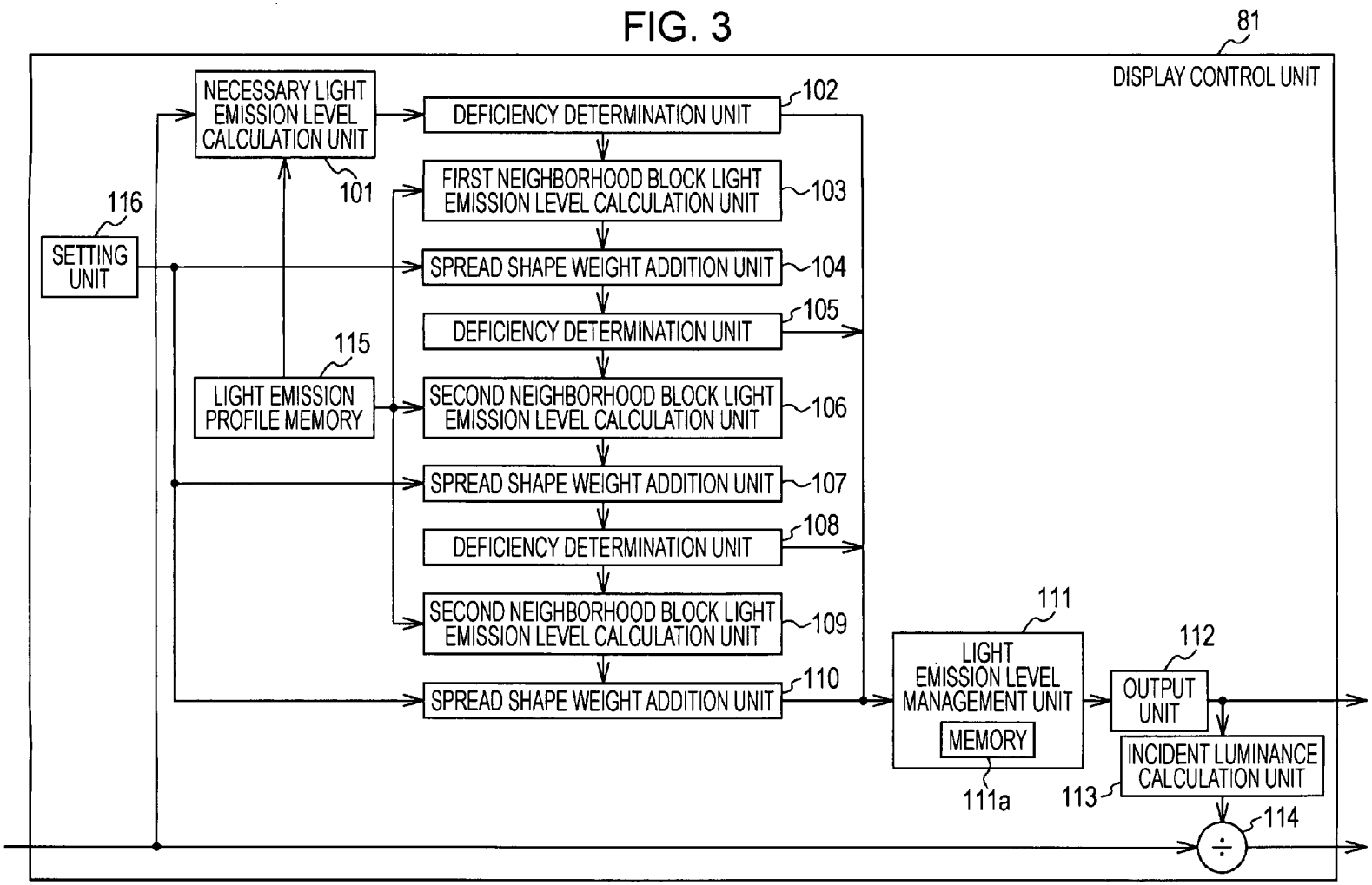
FIG. 3 is an explanatory diagram for describing a configuration example of a display control unit of FIG. 2.

Next, with reference to FIG. 3, a configuration example of a more detailed embodiment of the display control unit 81 of FIG. 2 will be described.

The display control unit 81 is composed of a necessary light emission level calculation unit 101, a deficiency determination unit 102, a first neighborhood block light emission level calculation unit 103, a spread shape weight addition unit 104, a deficiency determination unit 105, a second neighborhood block light emission level calculation unit 106, a spread shape weight addition unit 107, a deficiency determination unit 108, a third neighborhood block light emission level calculation unit 109, a spread shape weight addition unit 110, a light emission level management unit 111, an output unit 112, an incident luminance calculation unit 113, a division unit 114, a light emission profile memory 115, and a setting unit 116.

The image signal input to the display control unit 81 of the display apparatus 61 is supplied to the necessary light emission level calculation unit 101 of the display control unit 81 and the division unit 123. This image signal is set, for example, as an image signal of a moving image.

On the basis of the supplied image signal, through a processing which will be described below, the necessary light emission level calculation unit 101 calculates the back light luminance of the light projected by the respective back lights 83 as the light emission level among the areas in the display image based on the image signal on the basis of the luminance (necessary luminance) of the area displayed on each block of the liquid crystal panel 85 corresponding to the respective blocks of the back light 83 and supplies the back light luminance to the deficiency determination unit 102.

It should be noted that the respective display areas of the liquid crystal panel 85 corresponding to the back lights 83 are areas obtained by virtually dividing the entire display area of the liquid crystal panel 85 and refer to areas where a majority of the light from the one back light 83 immediately below the back face of the liquid crystal panel 85 is incident.

For example, if the display area of the liquid crystal panel 85 is virtually divided into N areas in FIG. 2, the respective display areas corresponding to the respective back lights 83-1 to 83-N are the corresponding respective areas on the display areas. Hereinafter, the display area of the liquid crystal panel 85 corresponding to the back light 83 is also referred to as partial display area.

The deficiency determination unit 102 compares the light emission level for each of the respective blocks with the largest light emission level at which the light can be emitted in the respective blocks to determine as to the presence or absence of the deficiency in the light amount which can be emitted. In a case where it is determined that the deficiency is not caused, the deficiency determination unit 102 supplies the supplied light emission level to the light emission level management unit 111 as the back light luminance in the back light 83 in the corresponding block and stores the light emission level in a memory 111*a*. In a case where the light emission level with respect to the same block is already stored in the memory 111*a*, the light emission level management unit 111 compares with the supplied light emission level and stores the larger one of the light emission levels.

Also, in a case where it is determined that the deficiency is generated, the deficiency determination unit 102 supplies information on the largest light emission level of the back light 83 corresponding to the block where it is determined that the deficiency is generated to the first neighborhood block light emission level calculation unit 103.

The first neighborhood block light emission level calculation unit 103 reads out the respective profiles of first neighborhood blocks from the light emission profile memory 115 and calculates a light emission level at a time of emitting the light so as to compensate the deficiency with respect to the necessary luminance in an attention block on the basis of a total sum of contribution rates to the attention block of the diffused light caused by the light emission in the respective blocks to be supplied to the spread shape weight addition unit 104. The first neighborhood blocks mentioned herein are eight pieces of blocks adjacent to the block (attention block) where it is determined that the deficiency is generated in the horizontal direction, the vertical direction, and the oblique direction. Also, the light emission profile memory 115 stores information on a distribution of contribution rates by diffusion for each of the respective blocks of the back light 83.

The spread shape weight addition unit 104 adds a weight with respect to the light emission levels of the respective blocks of the first neighborhood blocks while corresponding to a diffusion shape to the surrounding by the light emission in the blocks of the respective back lights 83 previously set by the setting unit 116 which is provided with an operation function such as a button or a mouse to be supplied to the deficiency determination unit.

The deficiency determination unit 105 compares the light emission level necessary in the first neighborhood blocks with the largest light emission level at which the light can be emitted in the back light 83 of the respective blocks of the first neighborhood blocks to determine as to the presence or absence of a deficiency of the light amount at which the light can be emitted. In a case where it is determined that the deficiency is not caused, the deficiency determination unit 105 supplies the supplied necessary light emission level of the first neighborhood blocks and the largest light emission level of the attention block as the back light luminance in the back light 83 in the corresponding block to the light emission level management unit 111 and stores the light emission levels in the memory 111*a*. In a case where the light emission level with respect to the same block is already stored in the memory 111*a*, the light emission level management unit 111 compares with the supplied light emission level and stores the larger one of the light emission levels.

Also, in a case where a deficiency is generated even at the largest light emission level with respect to the necessary light emission level of the first neighborhood blocks, the deficiency determination unit 105 supplies the information on the largest light emission level of the back light 83 corresponding to the attention block where it is determined that the deficiency is generated and the largest light emission level of the first neighborhood blocks to the second neighborhood block light emission level calculation unit 106.

The second neighborhood block light emission level calculation unit 106 reads out the respective profiles of the second neighborhood blocks from the light emission profile memory 115, and on the basis of a total sum of the contribution rates to the attention block of the light diffused by the light emission of the respective blocks, calculates light emission levels at a time of emitting the light so as to compensate the deficiency with respect to the necessary luminance by the attention block and the first neighborhood blocks to be supplied to the spread shape weight addition unit 107. The second neighborhood blocks mentioned herein are 16 blocks adjacent to the first neighborhood blocks where it is determined that the deficiency is generated in the horizontal direction, the vertical direction, and the oblique direction at locations far from the processing handling blocks.

The spread shape weight addition unit 107 adds a weight with respect to the light emission levels of the respective blocks of the second neighborhood blocks while corresponding to a diffusion shape to the surrounding by the light emission in the blocks of the respective back lights 83 previously set by the setting unit 116 which is provided with the operation function such as the button or the mouse to be supplied to the deficiency determination unit 108.

The deficiency determination unit 108 compares the light emission level necessary in the second neighborhood blocks with the largest light emission level at which the light can be emitted in the back light 83 of the respective blocks of the second neighborhood blocks to determine as to the presence or absence of a deficiency of the light amount at which the light can be emitted. In a case where it is determined that the deficiency is not caused, the deficiency determination unit 108 supplies the supplied necessary light emission level of second neighborhood blocks, the largest light emission level of the attention block, and the largest light emission level of the first neighborhood blocks as the back light luminance in the back light 83 in the corresponding block to the light emission level management unit 111 to be stored in the memory 111*a*. In a case where the light emission level with respect to the same block is already stored in the memory 111*a*, the light emission level management unit 111 compares with the supplied light emission level and stores the larger one of the light emission levels.

Also, in a case where a deficiency is generated even at the largest light emission level with respect to the necessary light emission level of the second neighborhood blocks, the deficiency determination unit 108 supplies the information on the largest light emission level of the back light 83 corresponding to the attention block where it is determined that the deficiency is generated, the largest light emission level of the first neighborhood blocks, and the largest light emission level of the second neighborhood blocks to the third neighborhood block light emission level calculation unit 109.

The third neighborhood block light emission level calculation unit 109 reads out the respective profiles of third neighborhood blocks from the light emission profile memory 115, and on the basis of a total sum of the contribution rates to the attention block of the light diffused by the light emission of the respective blocks, calculates light emission levels at a time of emitting the light so as to compensate the deficiency with respect to the necessary luminance by the attention block, the first neighborhood blocks, and the second neighborhood blocks to be supplied to the spread shape weight addition unit 110. The third neighborhood blocks mentioned herein are 24 blocks adjacent to the second neighborhood blocks where it is determined that the deficiency is generated in the horizontal direction, the vertical direction, and the oblique direction at locations far from the processing handling blocks.

The spread shape weight addition unit 110 adds a weight with respect to the light emission levels of the respective blocks of the third neighborhood blocks while corresponding to a diffusion shape to the surrounding by the light emission in the blocks of the respective back lights 83 previously set by the setting unit 116 which is provided with the operation function such as the button or the mouse to be supplied as the back light luminance in the back light 83 in the corresponding block to the light emission level management unit 111, and stores the light emission levels in the memory 111*a*. In a case where the light emission level already stored in the memory 111*a* exists, the light emission level management unit 111 compares with the supplied light emission level and stores the larger one of the light emission levels.

The output unit 112 supplies the light emission levels stored in the memory 111*a* of the light emission level management unit 111 while corresponding to the respective blocks B1 to BN of the respective back lights 83-1 to 83-N as the back light luminance to the back light control units 82-1 to 82-N and the incident luminance calculation unit 113.

On the basis of the back light luminance supplied from the output unit 112, the incident luminance calculation unit 113 calculates a pixel incident luminance indicating a luminance of the light estimated to be incident on the pixel from the back light 83 for the respective pixels in the respective blocks of the liquid crystal panel 85 corresponding to the back light 83. That is, in a case where the back light 83 emits the light at the supplied back light luminance, the pixel incident luminance is information indicating the luminance of the light estimated to be incident on the pixel in the respective partial display areas from the back light 83.

For example, in a case where the corresponding back light 83 emits the light, the incident luminance calculation unit 113 previously holds a profile indicating how the light projected from the back light 83 is diffused as a distribution of a contribution rage in accordance with a distance. Then, when the back light 83 emits the light at the back light luminance supplied from the output unit 112, by using the held profile, the incident luminance calculation unit 113 obtains the luminance of the light estimated to be incident on the respective pixels in the respective blocks of the liquid crystal panel 85 corresponding to the back light 83 from the back light 83 and sets the luminance for each of those pixels as the pixel incident luminance.

When the incident luminance calculation unit 113 obtains the pixel incident luminance for each of the pixels in the respective blocks, those pixel incident luminances are supplied to the division unit 114.

The division unit 114 divides the signal value of the supplied image signal, in more detail, the luminance obtained from the signal value by the pixel incident luminance from the incident luminance calculation unit 113 to calculate the transmittance of the respective pixels in the respective blocks. Then, the division unit 114 supplies the calculated transmittance for each of the pixels to the liquid crystal panel control unit 84.

For example, a pixel attracting attention in the respective blocks is referred to as attention pixel. Also, a pixel incident luminance of the attention pixel is set as CL, a back light luminance of the back light 83 is set as BL, and also a luminance at the pixel on the display image at the same position as the attention pixel, that is, the pixel on the display image where the image displayed at the attention pixel is displayed is set as IL. Furthermore, a transmittance of the light in the attention pixel is set as T.

In this case, when the back light 83 emits the light at the back light luminance BL, the luminance of the light incident from the back light 83 on the attention pixel, that is, the pixel incident luminance of the attention pixel is CL. Then, when the attention pixel transmits the light of the pixel incident luminance CL incident from the back light 83 at the transmittance T, the luminance of the light projected from the attention pixel, that is, the luminance of the attention pixel perceived by a user viewing the liquid crystal panel 85 (hereinafter, which will be also referred to as display luminance OL) is represented by the pixel incident luminance CL×the transmittance T. When the display luminance OL is equal to the luminance IL of the pixel of, as the same image as the display image is displayed on the liquid crystal panel 85, if the display luminance OL is equal to the luminance IL, the following expression (1) is established.

$$\text{The transmittance } T = (\text{the luminance } IL \text{ of the pixel of the display image})/(\text{the pixel incident luminance } CL) \quad (1)$$

Therefore, the division unit 114 divides the supplied signal value of the image signal indicating the pixel value of the pixel of the display image corresponding to the attention pixel, in more detail, the luminance IL of the pixel of the display image by the pixel incident luminance of the attention pixel CL supplied from the incident luminance calculation unit 113, so that it is possible to calculate the appropriate transmittance T of the attention pixel.

Figure 4:
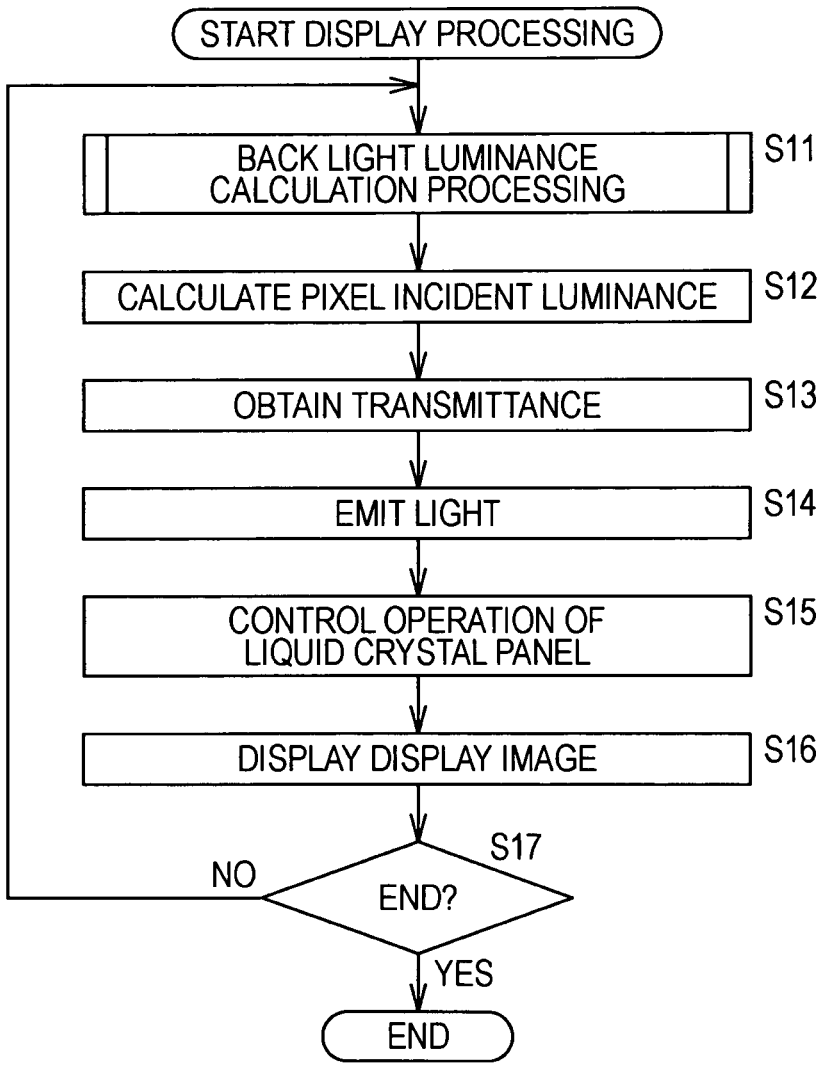
FIG. 4 is a flow chart for describing a display processing.

Next, with reference to a flow chart of FIG. 4, a display processing by the display apparatus 61 of FIG. 2 will be described.

In step S11, the display control unit 81 executes a back light luminance calculation processing which will be described below, calculates the back light luminance of the back light 83 for each block on the basis of the input image signal, and supplies the calculated back light luminance to the incident luminance calculation unit 113 and the back light control unit 82. It should be noted that the back light luminance calculation processing will be described below in detail with reference to a flow chart of FIG. 5.

In step S12, on the basis of the back light luminance supplied from the output unit 112, the incident luminance calculation unit 113 calculates the pixel incident luminance for each pixel of the respective blocks of the liquid crystal panel 85 corresponding to the back light 83. The incident luminance calculation unit 113' supplies the calculated pixel incident luminance to the division unit 114.

In step S13, the division unit 114 divides the supplied image signal by the pixel incident luminance supplied from the incident luminance calculation unit 113 to obtain the transmittance of the pixel for each pixel of the respective blocks to be supplied to the liquid crystal panel control unit 84.

In step S14, on the basis of the back light luminance supplied from the incident luminance calculation unit 113, the back light control unit 82 causes the back light 83 to emit the light at the back light luminance. Also, the back light 83 emits the light on the basis of the control of the back light control unit 82, so that the light at the specified back light luminance is incident on the liquid crystal panel 85.

It should be noted that the above-mentioned processing in steps S11 to S14 is collectively performed for the respective blocks by the display control unit 81. Also, the processing in step S14 is individually performed by each of the back light control unit 82-1 to the back light control unit 82-N and each of the back light 83-1 to the back light 83-N.

In step S15, the liquid crystal panel control unit 84 controls the operation of the liquid crystal panel 85 on the basis of the transmittance for each pixel in the display area of the liquid crystal panel 85 supplied from the display control unit 81 to change the transmittance of each pixel.

In step S16, on the basis of the control of the liquid crystal panel control unit 84, the liquid crystal panel 85 changes the transmittance of the pixel in the display area into the transmittance specified for each pixel to transmit the light incident from the back light 83, so that the display image is displayed.

In step S17, the display apparatus 61 determines whether or not the display of the display image is ended. For example, in a case where the user instructs the end of the display of the display image or the display image for all the frames of the supplied image signal is displayed, it is determined to end.

In step S17, in a case where it is determined that the display of the display image is not ended, the processing is returned to step S11, and the above-mentioned processing is repeatedly performed. That is, for the display image in the next frame, the back light luminance and the transmittance are obtained, and the display image thereof is displayed.

In contrast to this, in step S17, in a case where it is determined that the display of the display image is end, the respective units of the display apparatus 61 ends the performed processing, and the display processing is ended.

In this manner, when the image signal is supplied, the display apparatus 61 obtains the back light luminance and the transmittance to display the display image.

Figure 5:
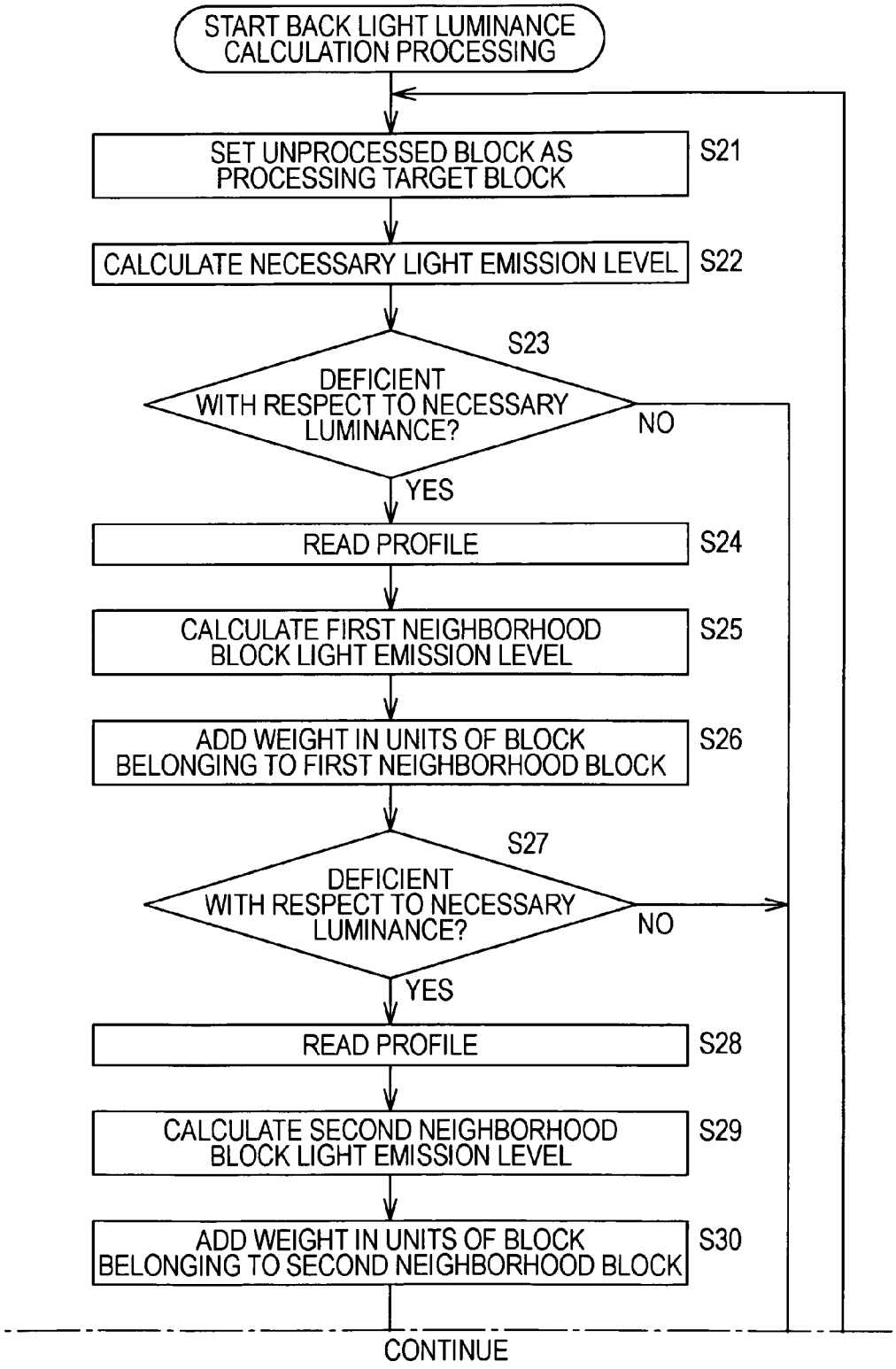
FIG. 5 is a flow chart for describing a back light luminance calculation processing.
Figure 5:
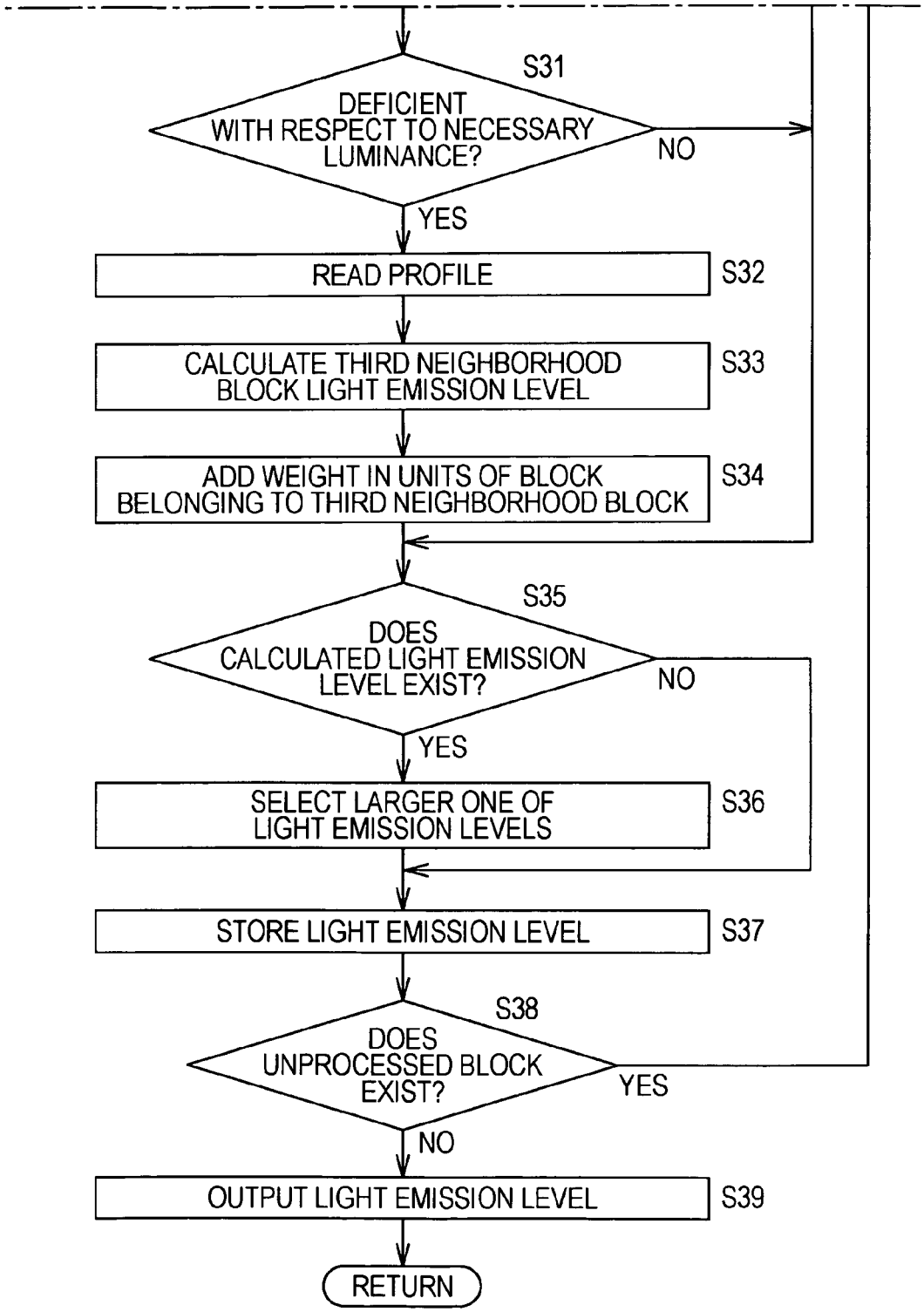

Next, with reference to the flow chart of FIG. 5, the back light luminance calculation processing which is the processing in step S11 in the flow chart of FIG. 4 will be described.

In step S21, the necessary light emission level calculation unit 101 sets any one of the unprocessed blocks as a processing target block.

In step S22, on the basis of the input image signal, the necessary light emission level calculation unit 101 obtains a necessary luminance p and calculates a light emission level of the processing target block corresponding to the necessary luminance p to be supplied to the deficiency determination unit 102. To be more specific, the necessary light emission level calculation unit 101 reads out a profile of the processing target block from the light emission profile memory 115, obtains a contribution rate r (the unit is %) with respect to the block set as the processing target, and rebates with respect to the necessary luminance p to obtain the necessary light emission level Ln (=p/(r/100)). Herein, the contribution rate is indicated, for example, by a profile represented by a curve in FIG. 6, which represents, when the processing target block is set as a block B(x), a contribution ratio of the light emitted from the processing target block B(x) while corresponding to a distance from the block. That is, in a case where the back light 83 corresponding to the processing target block B(x) emits the light, as being diffused, the light not only contributes for the light emission in the block corresponding to itself but also contributes for the light emission in the adjacent blocks and further adjacent blocks. For this reason, by the light emitted by the back light 83 corresponding to the processing target block B(x) shown in FIG. 6, the contribution rate to the processing target block B(x) is, for example, a value in the vicinity of a contribution rate $\alpha 1$. Also, the contribution rates to blocks B(x−1) and B(x+1) adjacent to the processing target block B(x) are values in the vicinity of a contribution rate $\alpha 2$, and further, the contribution rates to blocks B(x−2) and B(x+2) adjacent to the blocks B(x−1) and B(x+1) are values in the vicinity of a contribution rate $\alpha 3$.

Figure 6:
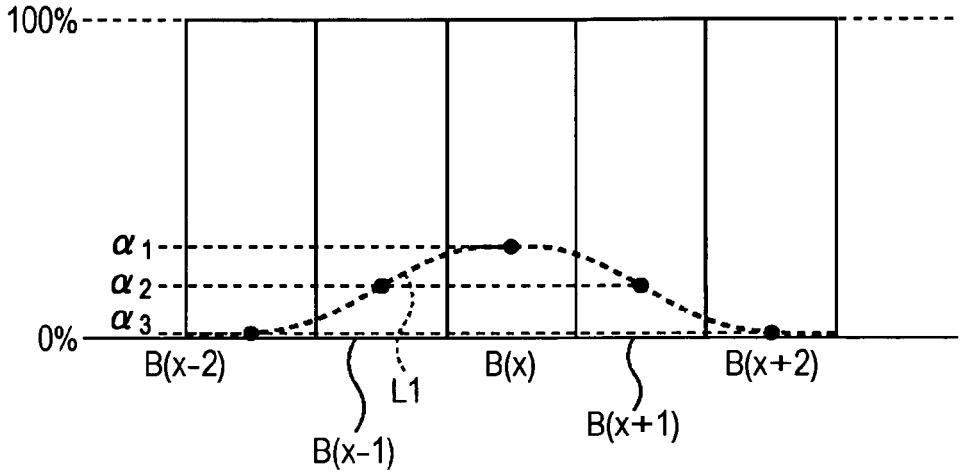
FIG. 6 is an explanatory diagram for describing a contribution rate.

It should be noted that as shown in the curved line of FIG. 6, as the contribution rate decreases in accordance with the distance from the center position of the blocks while taking the largest value immediately above the center position of the blocks where the light is emitted, in the case of considering in units of block, to suppress the luminance deficiency, the light emission level is calculated by using the largest value of the outermost peripheral part of the blocks as the reference for the computation.

In step S23, the deficiency determination unit 102 determines whether or not the deficiency of the largest light emission level Lm1 of the back light 83 corresponding to the processing target block is generated with respect to the necessary light emission level Ln.

Figure 7:
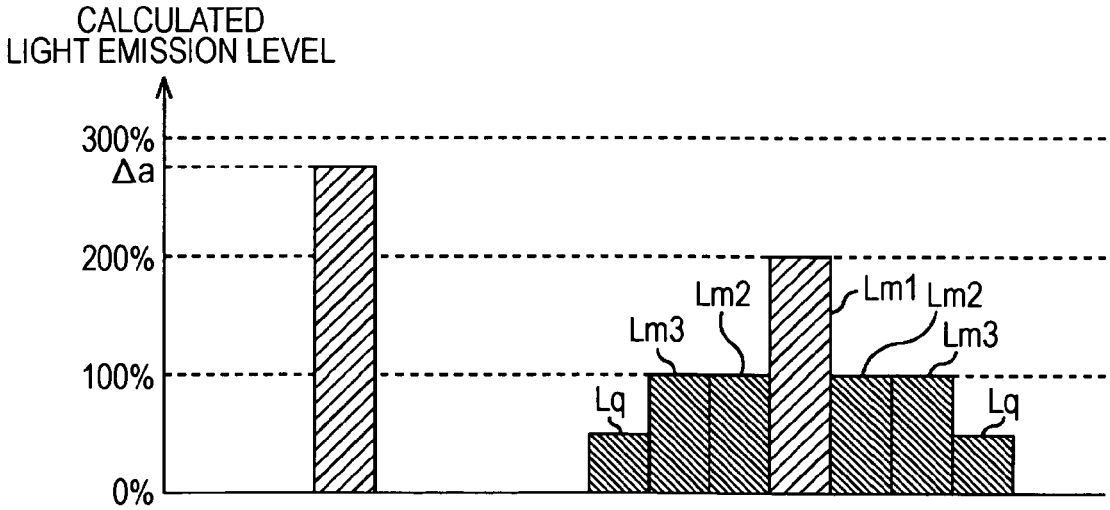
FIG. 7 is an explanatory diagram for describing an example of sharing a luminance.

In step S23, for example, in a case where the necessary light emission level Ln is a light emission level Aa equivalent to 280% when the largest light emission level Lm1 is set as 100% as shown in the left part of FIG. 7, in a case where it is determined that the deficiency of the largest light emission level Lm1 of the back light 83 corresponding to the processing target block is generated with respect to the necessary light emission level Ln, the deficiency determination unit 102 supplies a status where the deficiency is generated together with the information on the largest light emission level Lm1 of the back light 83 corresponding to the processing target block and the necessary luminance p to the first neighborhood block light emission level calculation unit 103.

In step S24, the first neighborhood block light emission level calculation unit 103 reads out the profiles of the respective blocks belonging to first adjacent blocks. Herein, as shown in FIG. 8, the first adjacent blocks are, for example, eight blocks B11 to B18 adjacent to the block (attention block) where it is determined that the deficiency is generated in the horizontal direction, the vertical direction, and the oblique direction when the processing target block B1 is set as the center.

In step S25, the first neighborhood block light emission level calculation unit 103 calculates the light emission level of the respective blocks belonging to the first adjacent blocks to be supplied to the spread shape weight addition unit 104 together with the information on the largest light emission level Lm1 of the back light 83 corresponding to the processing target block and the necessary luminance p. That is, on the basis of the profiles of the respective blocks, the first neighborhood block light emission level calculation unit 103 rebates at the contribution rate in accordance with the distance and calculates the light emission level of the back light 83 corresponding to the respective blocks of the first adjacent blocks necessary for satisfying the deficient luminance through the light emission by the back light 83 corresponding to the processing target block.

Figure 8:
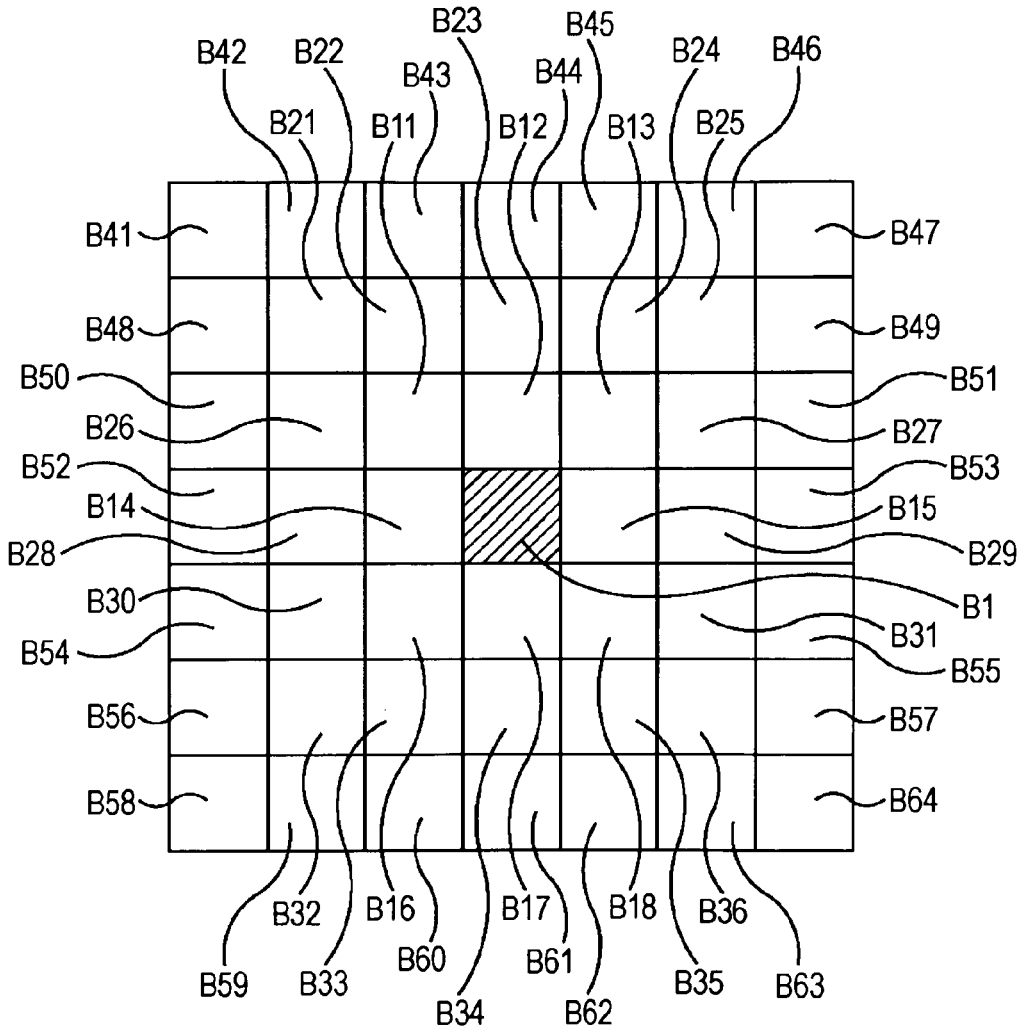
FIG. 8 is an explanatory diagram for describing a first adjacent block to a third adjacent block.

For example, in the case of the block B14 in FIG. 8, as it is considerable that the contribution rate to the processing target block B1 is a value in a vicinity of $\alpha 2$ as shown in FIG. 6, the light emission level is calculated so that the deficient luminance with respect to the necessary luminance p through the light emission by the back light 83 corresponding to the processing target block B1 can be shared ⅛ each. It should be noted that strictly speaking, as the distances to the processing target block are different in the blocks B11, B13, B16, and B18 and the blocks B12, B14, B15, and B17, contribution rates $\alpha x$ and $\alpha y$ are respectively obtained for the two types of the distance, and the light emission levels are respectively set. Also, for example, by using a unified contribution rate from an average distance of the blocks B11 to B18, the processing may be simplified through a processing by using a contribution rate $\alpha z$ in which the eight blocks are unified as one group. It should be noted that hereinafter, the description proceeds as it is supposed that for the blocks B11 to B18, through a unification by using the average of the distances from the processing target block, a light emission level Lo is obtained as the necessary light emission level.

In step S26, the spread shape weight addition unit 103 obtains the light emission levels of the respective blocks belonging to the first adjacent blocks adds a weight in accordance with a spread shape previously set by the setting unit 116 to be supplied together with the information on the largest light emission level Lm1 of the back light 83 corresponding to the processing target block, the necessary luminance p to the deficiency determination unit 105. The spread shape indicates in which shape the light is diffused as the back light 83 corresponding to one block emits the light. For example, in a case where the spread shape is set as square, as the blocks B11 to B18 belonging to the first adjacent blocks shown in FIG. 8 are disposed in a square shape and are the same as the diffusing shape, it is not necessary to add a weight, and a weight is evenly added to any of the blocks, so that the necessary light emission level Lo is output as it is.

Figure 9:
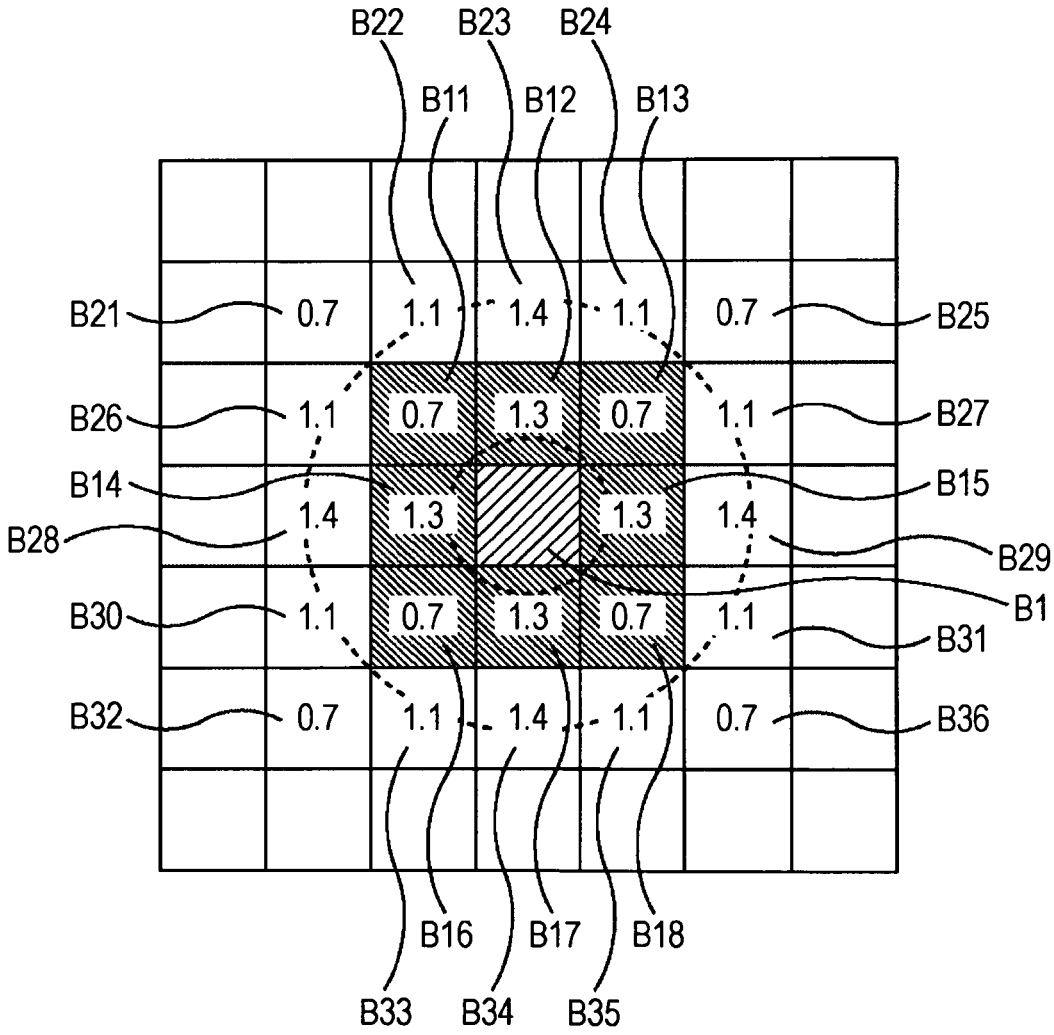
FIG. 9 is an explanatory diagram for describing a weight corresponding to a spread shape.

On the other hand, for example, in a case where the spread shape is circular, as shown in FIG. 9, while setting the processing target block B1 as the center, in accordance with a ratio of an occupying area belonging to a circular shape in the case of structuring the circular shape, for example, the weight of the blocks B11, B13, B16, and B18 is set as 0.7, and the weight of the other blocks B12, B14, B15, and B17 is set as 1.3 or the like, so that the respective necessary light emission levels are output as 0.7×Lo and 1.3×Lo.

In step S27, the deficiency determination unit 105 determines whether or not a deficiency in the largest light emission level Lm2 of the back light 83 corresponding to the respective blocks belonging to the first adjacent blocks is generated with respect to the necessary light emission level Lo belonging to the first adjacent blocks.

In step S27, for example, in a case where it is determined that the necessary light emission level Lo is deficient in the largest light emission level Lm2 of the back light 83 corresponding to the blocks belonging to the first adjacent blocks, the processing proceeds to step S28.

In step S28, the deficiency determination unit 105 supplies a status where the deficiency is generated together with the information on the largest light emission level Lm1 of the back light 83 corresponding to the processing target block, the largest light emission level Lm2 of the back light 83 corresponding to the first adjacent blocks, and the necessary luminance p to the first neighborhood block light emission level calculation unit 106. Furthermore, the second neighborhood block light emission level calculation unit 106 reads out profiles of the respective blocks belonging to second adjacent blocks. Herein, for example, as shown in FIG. 8, when the processing target block B1 is set as the center, the second adjacent blocks are 16 blocks of blocks B21 to B16 respectively adjacent to the first adjacent blocks in the horizontal direction, the vertical direction, and the oblique direction.

In step S29, the second neighborhood block light emission level calculation unit 106 calculates the light emission levels of the respective blocks belonging to the second adjacent blocks to be supplied to the spread shape weight addition unit 107 together with the information on the largest light emission level Lm1 of the back light 83 corresponding to the processing target block, the largest light emission level Lm2 of the blocks belonging to the first adjacent blocks, and the necessary luminance p. That is, the second neighborhood block light emission level calculation unit 106 rebates at the contribution rate in accordance with the distance on the basis of the profiles of the respective blocks and calculates the light emission level of the back light 83 corresponding to the respective blocks of the second adjacent blocks necessary to satisfy the deficiency through the light emission by the back light 83 corresponding to the processing target block and the first adjacent blocks.

For example, in the case of FIG. 8, the second neighborhood block light emission level calculation unit 106 sets the light emission level so that it is possible to share 1/16 of the luminance deficient with respect to the necessary luminance p through the light emission by the back light 83 corresponding to the processing target block B1 and the first adjacent blocks B11 to B18. It should be noted that as described above, strictly speaking, as distances to the processing target block are different in the blocks B21 to B36, the contribution rates in accordance with the respective distances are obtained. However, similarly as in the first adjacent blocks, the second neighborhood block light emission level calculation unit 106 uses the unified contribution rate from the average distance of the blocks B21 to B26 and uses a contribution rate au in which the 16 blocks are unified as the one group to perform the processing so as to simplify the processing, so that a unified light emission level Lp with respect to the blocks B21 to B36 is calculated.

In step S30, the spread shape weight addition unit 107 obtains the light emission levels of the respective blocks belonging to the second adjacent blocks and adds a weight corresponding to the spread shape previously set by the setting unit 116 to be supplied to the deficiency determination unit 108 together with the information on the largest light emission levels Lm1 and Lm2 of the back light 83 corresponding to the largest light emission level of the processing target block and the first adjacent blocks, and the necessary luminance p. For example, in a case where the spread shape is square, as the blocks B21 to B36 belonging to the second adjacent blocks shown in FIG. 8 are disposed in a square shape, a weight is evenly added to any of the blocks, so that the necessary light emission level Lp is output as it is.

On the other hand, for example, in a case where the spread shape is circular, as shown in FIG. 9, while setting the processing target block B1 as the center, in accordance with a ratio of an occupying area to a ratio configuring the circular shape, for example, the weight for the blocks B21, B25, B32, and B36 is set as 0.7, the weight for the blocks B22, B24B26, B27, B30, B31, B33, and B35 is set as 1.1, and the weight for the other blocks B23, B28, B29, and B34 is set as 1.4 or the like, so that the output is performed while the respective necessary light emission levels are set as 0.7×Lp, 1.1×Lp, and 1.4×Lp.

In step S31, the deficiency determination unit 108 determines whether or not a deficiency in the largest light emission level Lm3 of the back light 83 corresponding to the respective blocks belonging to the second adjacent blocks with respect to the necessary light emission level Lp is generated.

In step S31, for example, in a case where it is determined that the necessary light emission level Lp is deficient in the largest light emission level Lm3 of the back light 83 corresponding to the blocks belonging to the second adjacent blocks, the processing proceeds to step S31.

In step S32, the deficiency determination unit 108 supplies a status where the deficiency is generated to the third neighborhood block light emission level calculation unit 109 together with the information on the largest light emission level Lm1 of the back light 83 corresponding to the processing target block, the largest light emission level Lm2 of the back light 83 corresponding to the first adjacent blocks, the largest light emission level Lm3 of the back light 83 corresponding to the second adjacent blocks, and the necessary luminance p. Furthermore, the third neighborhood block light emission level calculation unit 109 reads out the profiles of the respective blocks belonging to third adjacent blocks. Herein, as shown in FIG. 8, the third adjacent blocks are, for example, 24 blocks of the blocks B41 to B64 adjacent to the respective second adjacent blocks in the horizontal direction, the vertical direction, and the oblique direction when is set as the center.

In step S33, the third neighborhood block light emission level calculation unit 109 calculates the light emission levels of the respective blocks belonging to the third adjacent blocks to be supplied to the spread shape weight addition unit 110 together with the information on the largest light emission level Lm1 of the back light 83 corresponding to the processing target block, the largest light emission level Lm2 of the blocks belonging to the first adjacent blocks, the largest light emission level Lm3 of the back light 83 corresponding to the second adjacent blocks, and the necessary luminance p. That is, the third neighborhood block light emission level calculation unit 109 rebates at the contribution rate in accordance with the distance on the basis of the profiles of the respective blocks and calculates the light emission level of the back light 83 corresponding to the respective blocks of the third adjacent blocks which is necessary for satisfying the deficient luminance through the light emission of the back light 83 corresponding to the processing target block, the first adjacent blocks, and the second adjacent blocks.

For example, the third neighborhood block light emission level calculation unit 109 sets the light emission level so that 1/24 of the deficient luminance with respect to the necessary luminance p can be shared through the light emission by the back light 83 corresponding to the processing target block B1, the first adjacent blocks B11 to B18, and the second adjacent blocks B21 to B36. It should be noted that as described above, strictly speaking, as the distances to the processing target block are different in the blocks B41 to B64, the contribution rates in accordance with the distance are obtained. However, similarly as in the first adjacent blocks, the processing is simplified through the processing by using a contribution rate at unified from the average distance of the blocks B41 to B64 and unifying the 24 blocks into one group, and a light emission level Lq unified with respect to the blocks B41 to B64 is set.

In step S34, similarly as in the spread shape weight addition units 104 and 107, the spread shape weight addition unit 110 obtains the light emission levels of the respective blocks belonging to the third adjacent blocks and adds a weight corresponding to the spread shape previously set by the setting unit 116 to be supplied to the light emission level management unit 111.

On the other hand, in steps S23, S27, and S30, in a case where the deficiency is not generated in the light emission level, the necessary light emission level (the light emission level at which the light can be emitted) Ln of the processing target block at that time, or the largest light emission level Lm1 of the processing target block and the necessary light emission level (the light emission level at which the light can be emitted) Lo of the first adjacent blocks, or the largest light emission level Lm1 of the processing target block, the largest light emission level Lm2 of the first adjacent blocks, and the necessary light emission level (the light emission level at which the light can be emitted) Lp of the second adjacent blocks are respectively supplied to the light emission level management unit 111.

In step S35, the light emission level management unit 111 accesses the memory 111*a* to determine whether or not regarding the supplied light emission levels set in the respective blocks of the processing target block, the first adjacent blocks, the second adjacent blocks, and the third adjacent blocks, the light emission level for the corresponding light emission levels already exist.

In step S35, in a case where the information on the light emission levels already stored exists, in step S36, the light emission levels are compared to select the larger one of the light emission levels.

In step S37, the light emission level management unit 111 stores the light emission level supplied from the spread shape weight addition unit 110 (or, the deficiency determination unit 102, 105, or 108) in the memory 111*a* for each block.

It should be noted that in step S35, in a case where the information on the light emission levels already stored does not exist, the processing in step S36 is skipped.

In step S37, the necessary light emission level calculation unit 101 determines whether or not the unprocessed block exists. In a case where the unprocessed block exists, the processing returns to step S21, and until it is determined that the unprocessed block does not exists, the processing in steps S21 to S37 is repeatedly performed. Then, in step S37, in a case where it is determined that the unprocessed block does not exist, in step S38, the output unit 112 supplies the information on the light emission levels stored in the memory 111*a* to the respective back light control units 82 and also supplies to the incident luminance calculation unit 113.

As a result, for example, as shown in the right part of FIG. 7, if the light emission level of the processing target block is virtually up to about 200% at maximum, the processing target block emits the light at the largest light emission level Lm1, the first adjacent blocks emits the light at the largest light emission level Lm2, the second adjacent blocks emits the light at the largest light emission level Lm3, and the third adjacent blocks emits the light at the necessary light emission level Lq. With the luminance contributed to the processing target block (center block) through the respective light emissions, it is possible to enable the light emission at a level (200%) beyond a level at which the light can be emitted independently (100%). Even when an expected value equal to or larger than the luminance at which the light can be emitted independently is calculated, it is possible to suppress the luminance deficiency. It should be noted that as the light emission level beyond the light emission level at which the light can be emitted independently, the example of 200% has been described, but depending on a performance of the back light 83, the larger light emission level can also be realized.

Also, when the light emission levels are redundantly calculated with respect to the respective blocks, the largest light emission level is regularly selected. Even when a small light emission level is set with the weight addition based on the spread shape, through the computation while setting the other blocks as the processing targets, the value replaces when the large light emission level is calculated as the necessary light emission level, and it is possible to suppress the luminance deficiency due to the weight addition.

It should be noted that in the above, the example in which the neighborhood block groups from the first neighborhood blocks to the third neighborhood blocks are set while corresponding to the processing target block has been described, but it may also suffice that the neighborhood blocks is set in accordance with the distance from the processing target block, so that the neighborhood block group composed of other configurations may be structured in accordance with the distance from the processing target block.

According to the present invention, it is possible to suppress the luminance deficiency by the back light.

Incidentally, the above-mentioned series of processings can be executed by hardware but can also be executed by software. In a case where the above-mentioned series of processings is executed by the software, a program structuring the software is installed from a recording medium into a computer incorporated in dedicated-use hardware or, for example, a general-use personal computer or the like which is capable of executing various functions by installing various programs.

Figure 10:
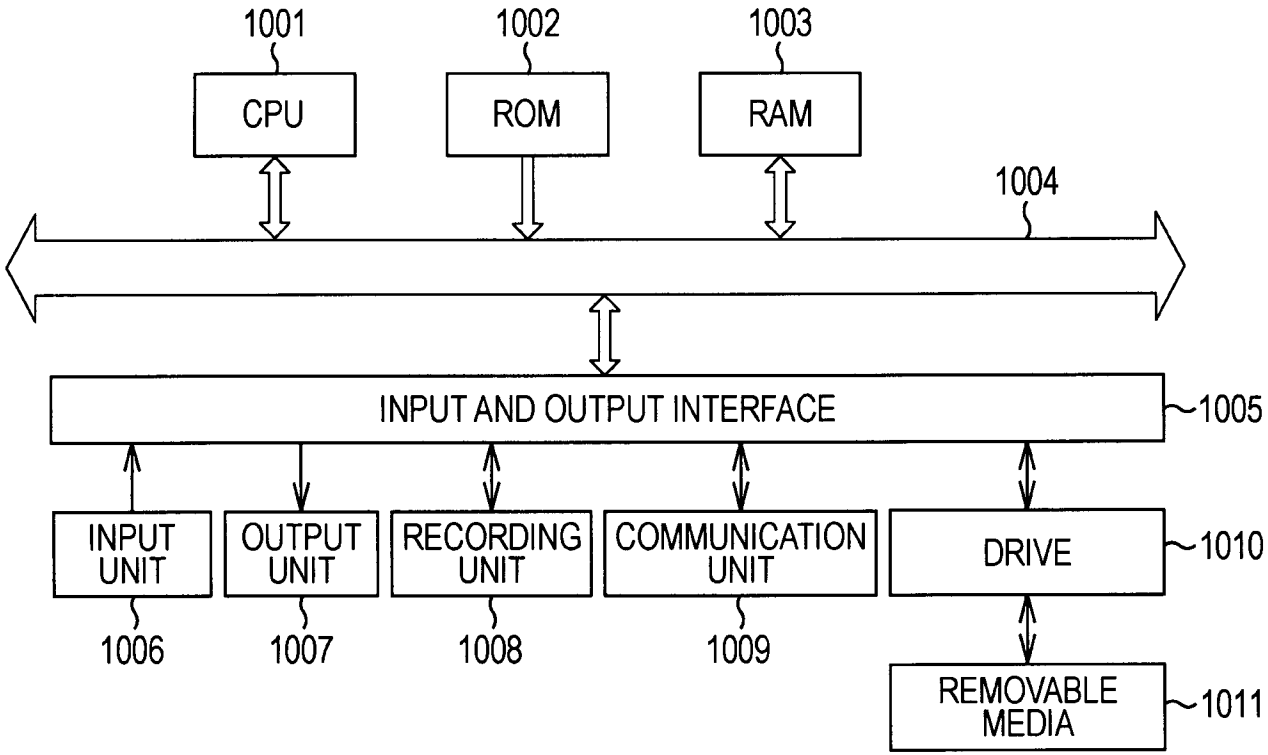
FIG. 10 is an explanatory diagram for describing a configuration example of a general-use personal computer.

FIG. 10 shows a configuration example of the general-use personal computer. This personal computer accommodates a CPU (Central Processing Unit) 1001. To the CPU 1001, an input and output interface 1005 is connected via a bus 1004. To the bus 1004, a ROM (Read Only Memory) 1002 and a RAM (Random Access Memory) 1003 are connected.

To the input and output interface 1005, an input unit 1006 composed of an input device such as a key board or a mouse with which the user inputs an operation command, an output unit 1007 for outputting a processing operation screen and an image of a processing result to a display device, a storage unit 1008 composed of a hard disk drive or the like for storing programs and various data, and a communication unit 1009 composed of a LAN (Local Area Network) adapter or the like for executing a communication processing via a network represented by the internet are connected. Also, a drive 1010 is connected for reading and writing data with respect to a removable media 1011 such as a magnetic disk (including a flexible disk), an optical disk (including a CD-ROM (Compact Disc-Read Only Memory) and a DVD (Digital Versatile Disc)), an opto-magnetic disk (including an MD (Mini Disc)), or a semiconductor memory.

The CPU 1001 executes various processings while following the programs stored in the ROM 1002 or the programs read from the removable media 1011 such as the magnetic disk, the optical disk, the opto-magnetic disk, or the semiconductor memory installed into the storage unit 1008 and loaded from the storage unit 1008 to the RAM 1003. The RAM 1003 appropriately stores data and the like necessary for the CPU 1001 to execute the various processings.

It should be noted that in the present specification, steps for describing the program recorded in the recording medium include not only the processing executed in a time sequence manner while following the stated order but also the processing executed in parallel or individually instead of not necessarily being processed in the time sequence manner.

EXPLANATION OF REFERENCE NUMERALS

61 DISPLAY APPARATUS, 81-1 TO 81-N, 81 DISPLAY CONTROL UNIT, 82-1 TO 82-N, 82 BACK LIGHT CONTROL UNIT, 83-1 TO 83-N, 83 BACK LIGHT, 84 LIQUID CRYSTAL PANEL CONTROL UNIT, 85 LIQUID CRYSTAL PANEL, 101 NECESSARY LIGHT EMISSION LEVEL CALCULATION UNIT, 102 DEFICIENCY DETERMINATION UNIT, 103 FIRST NEIGHBORHOOD BLOCK LIGHT EMISSION LEVEL CALCULATION UNIT, 104 SPREAD SHAPE ADDITION UNIT, 105 DEFICIENCY DETERMINATION UNIT, 106 SECOND NEIGHBORHOOD BLOCK LIGHT EMISSION LEVEL CALCULATION UNIT, 107 SPREAD SHAPE ADDITION UNIT, 108 DEFICIENCY DETERMINATION UNIT, 109 THIRD NEIGHBORHOOD BLOCK LIGHT EMISSION LEVEL CALCULATION UNIT, 110 SPREAD SHAPE ADDITION UNIT, 111 LIGHT EMISSION LEVEL MANAGEMENT UNIT, 111*a* MEMORY, 112 OUTPUT UNIT, 113 INCIDENT LUMINANCE CALCULATION UNIT, 114 DIVISION UNIT

The invention claimed is:

1. A display control apparatus comprising:

necessary attention block light emission level calculation means configured to calculate, based on an image signal of an image to be displayed, a light emission level by a back light in an attention block among back lights composed of a plurality of blocks, respectively, in which the back lights emit light at a time of emitting light by the back light in the attention block in accordance with a light emission profile thereof as a necessary attention block light emission level, wherein the necessary attention block light emission level is determined based on a contribution rate indicated by a light emission profile with respect to the block of the plurality of blocks corresponding to the attention block and with respect to a necessary luminance based on the image signal;

necessary first neighborhood block light emission level calculation means configured to calculate, in a case where a largest light emission level at which light can be emitted by the back light in the attention block, the largest light emission level determined from the light emission profile for the attention block, is less than the necessary attention block light emission level such that a deficient luminance with respect to the necessary luminance exists, a light emission level of first neighborhood blocks at a time of emitting light by back lights in the first neighborhood blocks in accordance with respective light emission profiles thereof as a necessary first neighborhood block light emission level, wherein the necessary first neighborhood block light emission level is determined from contribution rates to the attention block indicated by respective light emission profiles of the first neighborhood blocks to compensate for the deficient luminance with respect to the necessary luminance and corresponds to a light emission contribution amount to the attention block through light emission in the first neighborhood blocks in a neighborhood of the attention block which compensates for the deficient luminance by the back light in the attention block, wherein the necessary first neighborhood block emission level is determined using at least one of a largest value of a contribution rate to the attention block of an outermost peripheral part of the first neighborhood blocks or a unified contribution rate based on an average distance of the first neighborhood blocks to the attention block; and back light light-emission control means configured to cause the back light in the attention block to emit the light at the largest light emission level at which the light can be emitted and the back lights in the first neighborhood blocks to emit the light at the necessary first neighborhood block light emission level.

2. The display control apparatus according to claim 1 further comprising:

necessary second neighborhood block light emission level calculation means configured to calculate, in a case where a largest light emission level at which the light can be emitted by the back lights in the first neighborhood blocks is less than the necessary first neighborhood block light emission level, a light emission level of second neighborhood blocks at a time of emitting light by back lights in the second neighborhood blocks in accordance with respective light emission profiles thereof as a necessary second neighborhood block light emission level, wherein the necessary second neighborhood block light emission level is determined from contribution rates to the attention block indicated by respective light emission profiles of the second neighborhood blocks to compensate for the deficient luminance with respect to the necessary luminance and corresponds to a light emission contribution amount to the attention block through light emission in the second neighborhood blocks in a neighborhood of the attention block and a neighborhood farther than the first neighborhood blocks, wherein the back light light-emission control means causes the back light in the attention block and the back lights in the first neighborhood blocks to emit the light at the respective largest light emission levels and the back lights in the second neighborhood blocks to emit the light at the necessary second neighborhood block light emission level.

3. The display control apparatus according to claim 2 further comprising:

first weight addition means configured to add a weight on the light emission level of the first neighborhood blocks, the light emission level of the first neighborhood blocks being calculated by the necessary first neighborhood block light emission level calculation means, wherein the weight corresponds to a predetermined set shape of the light spread from the attention block.

4. The display control apparatus according to claim 3 further comprising:

second weight addition means configured to add a weight on the light emission level of the second neighborhood blocks, the light emission level of the second neighborhood blocks being calculated by the necessary second neighborhood block light emission level calculation unit, wherein the weight corresponds to the predetermined set shape of the light spread from the attention block.

5. A display control method comprising:

a necessary attention block light emission level calculation step of calculating, based on an image signal of an image to be displayed, a light emission level by a back light in an attention block among back lights composed of a plurality of blocks, respectively, in which the back lights emit light at a time of emitting light by the back light in the attention block in accordance with a light emission profile thereof as a necessary attention block light emission level, wherein the necessary attention block light emission level is determined based on a contribution rate indicated by a light emission profile with respect to the block of the plurality of blocks corresponding to the attention block and with respect to a necessary luminance based on the image signal;

a necessary first neighborhood block light emission level calculation step of calculating, in a case where a largest light emission level at which light can be emitted by the back light in the attention block, the largest light emission level determined from the light emission profile for the attention block, is less than the necessary attention block light emission level such that a deficient luminance with respect to the necessary luminance exists, a light emission level of first neighborhood blocks at a time of emitting light by back lights in the first neighborhood blocks in accordance with respective light emission profiles thereof as a necessary first neighborhood block light emission level, wherein the necessary first neighborhood block light emission level is determined from contribution rates to the attention block indicated by respective light emission profiles of the first neighborhood blocks to compensate for the deficient luminance with respect to the necessary luminance and corresponds to a light emission contribution amount to the attention block through light emission in the first neighborhood blocks in a neighborhood of the attention block which compensates for deficient luminance by the back light in the attention block, wherein the necessary first neighborhood block emission level is determined using at least one of a largest value of a contribution rate to the attention block of an outermost peripheral part of the first neighborhood blocks or a unified contribution rate based on an average distance of the first neighborhood blocks to the attention block; and a back light light-emission control step of causing the back light in the attention block to emit the light at the largest light emission level at which the light can be emitted and the back lights in the first neighborhood blocks to emit the light at the necessary first neighborhood block light emission level.

6. A non-transitory storage medium recorded with a program for causing a computer to execute a processing comprising:

a necessary attention block light emission level calculation step of calculating, based on an image signal of an image to be displayed, a light emission level by a back light in an attention block among back lights composed of a plurality of blocks, respectively, in which the back lights emit light at a time of emitting light by the back light in the attention block in accordance with a light emission profile thereof as a necessary attention block light emission level, wherein the necessary attention block light emission level is determined based on a contribution rate indicated by a light emission profile with respect to the block of the plurality of blocks corresponding to the attention block and with respect to a necessary luminance based on the image signal;

a necessary first neighborhood block light emission level calculation step of calculating, in a case where a largest light emission level at which light can be emitted by the back light in the attention block, the largest light emission level determined from the light emission profile for the attention block, is less than the necessary attention block light emission level such that a deficient luminance with respect to the necessary luminance exists, a light emission level of first neighborhood blocks at a time of emitting light by back lights in the first neighborhood blocks in accordance with respective light emission profiles thereof as a necessary first neighborhood block light emission level, wherein the necessary first neighborhood block light emission level is determined from contribution rates to the attention block indicated by respective light emission profiles of the first neighborhood blocks to compensate for the deficient luminance with respect to the necessary luminance and corresponds to a light emission contribution amount to the attention block through light emission in the first neighborhood blocks in a neighborhood of the attention block which compensates for the deficient luminance by the back light in the attention block, wherein the necessary first neighborhood block emission level is determined using at least one of a largest value of a contribution rate to the attention block of an outermost peripheral part of the first neighborhood blocks or a unified contribution rate based on an average distance of the first neighborhood blocks to the attention block; and a back light light-emission control step of causing the back light in the attention block to emit the light at the largest light emission level at which the light can be emitted and the back lights in the first neighborhood blocks to emit the light at the necessary first neighborhood block light emission level.

7. A display control apparatus comprising:

necessary attention block light emission level calculation means configured to set a back light among back lights, the back lights composed of a plurality of blocks, respectively, in which the back lights emit light, based on an image signal of an image to be displayed, and to calculate a light emission level by the set back light in an attention block at a time of emitting light by the set back light in the attention block in accordance with a light emission profile thereof as a necessary attention block light emission level, wherein the necessary attention block light emission level is determined based on a contribution rate indicated by a light emission profile with respect to the block of the plurality of blocks corresponding to the attention block and with respect to a necessary luminance based on the image signal; and back light light-emission control means configured to cause the set back light in the attention block to emit light at the largest light emission level at which the light can be emitted and back lights respectively in the first neighborhood blocks to emit the light at a necessary first neighborhood block light emission level to compensate for an amount that a largest light emission level at which light can be emitted by the set back light in the attention block, the largest light level of the set back light in the attention block determined from the light emission profile for the attention block, is less than the necessary attention block light emission level such that a deficient luminance with respect to the necessary luminance is suppressed, wherein the necessary first neighborhood block light emission level is determined at a time of emitting light by back lights in the first neighborhood blocks in accordance with respective light emission profiles thereof and from contribution rates to the attention block indicated by respective light emission profiles of the first neighborhood blocks to compensate for the deficient luminance with respect to the necessary luminance and corresponds to a light emission contribution amount to the attention block through light emission in the first neighborhood blocks in a neighborhood of the attention block which compensates for the deficient luminance by the set back light in the attention block, wherein the necessary first neighborhood block emission level is determined using at least one of a largest value of a contribution rate to the attention block of an outermost peripheral part of the first neighborhood blocks or a unified contribution rate based on an average distance of the first neighborhood blocks to the attention block.

* * * * *